United States Patent [19]

Sokoly et al.

[11] 4,296,002

[45] Oct. 20, 1981

[54] METAL OXIDE VARISTOR MANUFACTURE

[75] Inventors: Theodore O. Sokoly, Racine; John Niedzialkowski, Milwaukee, both of Wis.

[73] Assignee: McGraw-Edison Company, Rolling Meadows, Ill.

[21] Appl. No.: 51,872

[22] Filed: Jun. 25, 1979

[51] Int. Cl.[3] ..... H01B 1/06

[52] U.S. Cl. ..... 252/518; 252/519; 252/520; 252/521; 338/20

[58] Field of Search ..... 252/518, 519-521; 75/206, 208; 338/20, 21; 264/58, 61

[56] References Cited

U.S. PATENT DOCUMENTS

| | | | |
|---|---|---|---|
| 3,899,451 | 8/1975 | Ichinose et al. | 252/518 |
| 3,953,373 | 4/1976 | Matsura et al. | 252/520 |
| 3,953,375 | 4/1976 | Nagano et al. | 252/520 |
| 3,959,543 | 5/1976 | Ellis | 252/518 |

*Primary Examiner*—J. L. Barr

*Attorney, Agent, or Firm*—Charles W. MacKinnon; Jon Carl Gealow; Ronald J. LaPorte

[57] ABSTRACT

The method of manufacturing metal oxide varistors wherein pressed blocks of selected mixtures of metal oxide powders and additives are joined to form a single varistor unit by vertically stacking and firing the blocks at a high temperature. Sintering of these stacked blocks during the firing cycle results in a strong mechanical and electrical bond between the adjacent blocks in the stack.

6 Claims, 2 Drawing Figures

METAL OXIDE VARISTOR MANUFACTURE

BACKGROUND OF INVENTION

1. Field of Invention

This invention relates generally to a nonlinear voltage variable resistor which is produced by molding and sintering metallic oxide mixtures, and, more particularly, to a method of manufacturing a high voltage metal oxide varistor.

2. Description of the Prior Art

Metal oxide varistors, consisting of a ceramic material, sintered at a high temperature, containing primarily one electrically conductive metallic oxide such as ZnO, $TiO_2$, $SnO_2$, or $SrO_2$, with small amounts of other selected metal oxides or fluorides, are well known to the art. For example, U.S. Pat. No. 3,953,373, issued Apr. 27, 1976 to Matsuura et al, describes various compositions of metal oxide varistors in which the major conductive component is zinc oxide. U.S. Pat. No. 3,953,375, issued Apr. 27, 1976 to Nagano et al describes various compositions of metal oxide varistors in which the major conductive component is titanium oxide, and U.S. Pat. No. 3,899,451, issued Aug. 12, 1975 to Ichinose et al, describes various compositions of metallic oxide varistors in which the main conductive components are select mixtures of $Zn_O$ with $TiO_2$, $SnO_2$, or $ZrO_2$. Additives which may be used in these metal oxide varistors include the oxides or fluorides of bismuth, cobalt, manganese, barium, boron, berylium, magnesium, calcium, strontium, titanium, antimony, germanium, chromium, nickel, lithium, indium, cerium, aluminum, tin, molydenum, vandium, tantalum and iron.

The manufacturing process for all such metal oxide varistors is similar. Accurately weighed quantities of metal oxides and additives, having predetermined composition ratio, are powdered and mixed together, generally by a ball mill. The mixture may be preliminarily calcined at a relatively low temperature in the range of 400° C to 1000° C and again pulverized in a ball mill. The powder thus obtained is mixed with a suitable binder such as water, polyvinyl alcohol, etc. and shaped under a pressure of about 50 to 1000 kg/cm$^2$, into a disc or block having very smooth, planar, parallel top and bottom surfaces. These blocks are then sintered at a high temperature, in the range of 1000° C to 1450° C, for about 1 to 20 hours, then furnace-cooled to room temperature. The sintered blocks are provided at their respective top and bottom surfaces with ohmic electrodes applied by a suitable method such as silver painting, vacuum evaporation, or flame spraying of metals such as Al, Zn, Sn, etc. The top and bottom surfaces of the block may be lapped before the electrodes are applied thereon to assure a uniform thickness of the block.

Generally, the unfired varistor blocks are formed by uniaxially cold pressing the selected mixture of metal oxide powders and additives into a disc or block. In such a molding process, the thickness of the block thus produced is quite restricted, generally not exceeding the diameter of the block. Since the voltage rating of a metal oxide varistor is directly dependent on its thickness for any given formulation, when these varistor blocks are used in high voltage devices, such as lightning arresters for transmission or distribution power lines, it has heretofore been common practice to electrically connect a plurality of these varistor blocks in series via the two opposite metalized contacts of each varistor block or element. For example, in the lightning arrester disclosed in U.S. Pat. No. 3,959,543, issued May 25, 1976 to Howard F. Ellis, a plurality of vertically stacked metal oxide resistors are electrically connected in series by the fusing of silver paste layers previously applied to both faces of each metal oxide varistor disc.

SUMMARY OF THE INVENTION

Therefore, it is the primary object of this invention to provide a method of manufacturing a high voltage metal oxide varistor comprised of stacked varistor blocks which requires only two metalized contacts, at opposite ends thereof, and which exhibits equal or better electrical characteristics than known high voltage metal oxide varistor assemblies comprising a plurality of series connected varistor blocks or elements.

This object is achieved by stacking a plurality of the pressed powder discs prior to the normal firing cycle. The sintering of these blocks or discs if vertically stacked during the firing operation results in an extremely strong mechanical and electrical bond between the individual blocks. If the blocks are not stacked in a vertical arrangement whereby gravity provides a force between the blocks, a clamping force may be applied to the stack through the end blocks. Thus, only two metalized contacts, one at each end of the fused varistor assembly, are required to connect the varistor to a high voltage circuit, or as the valve element of a lightning arrester or similar overvoltage protective device.

DESCRIPTION OF PREFERRED EMBODIMENT

Figure 1:
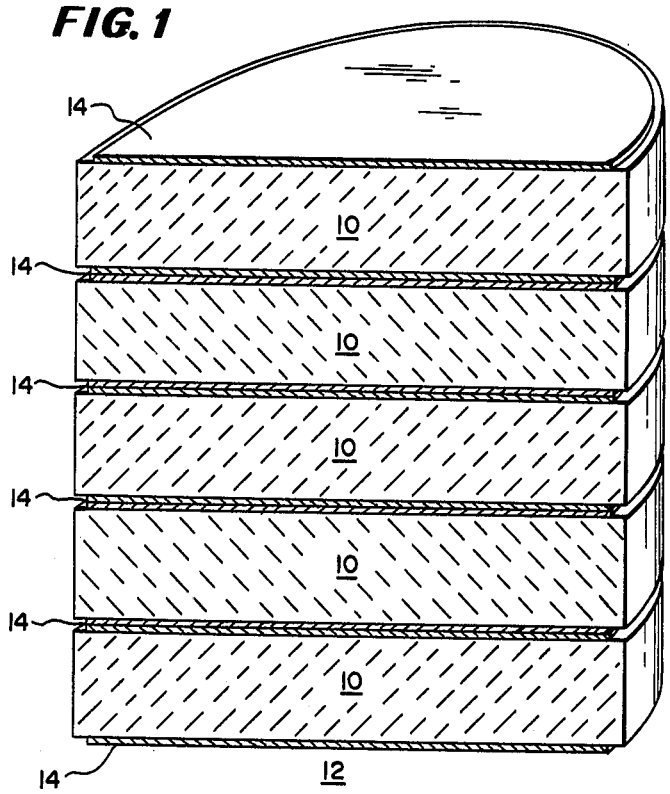
FIG. 1 is a perspective cross-sectional view of a conventional metal oxide varistor assembly, in which individual varistor elements are connected in series by metalized contacts on each element.

Referring now to FIG. 1, a plurality of metal oxide varistor elements or blocks 10 are electrically connected in series to form a high voltage varistor assembly 12, suitable for use as the valve element in a lightning arrester or the like. Each varistor element 10 is conventionally made by uniaxially cold pressing a selected mixture of metal oxide powder and small quantities of powdered metal oxide or fluoride additives into a cylindrical shaped disc, firing the disc, grinding or lapping the disc to obtain the desired degree of flatness and parallelism on the opposite top and bottom surfaces of the disc, and then applying ohmic electrodes 14 to the top and bottom surfaces. The varistor elements 10 are electrically connected in series by vertically stacking the elements 10 so that, except for the lower most element 10, the bottom electrode 14 of each varistor element 10 makes electrical contact with the top electrode of the adjacent lower varistor element 10. Adjacent electrodes may be fused together to improve the electrical conductivity between the varistor elements 10 as described in the above referenced U.S. Pat. No. 3,959,543.

Figure 2:
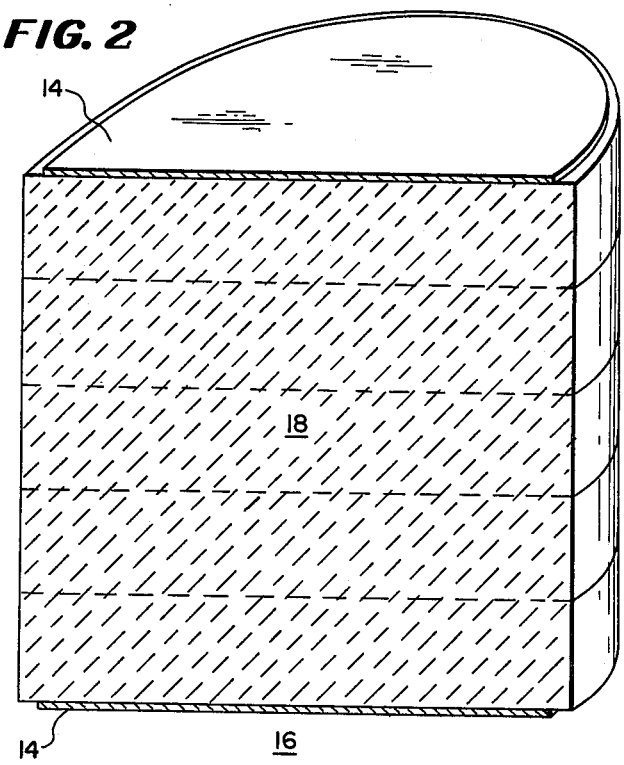
FIG. 2 is a perspective cross-sectional view of a high voltage metal oxide varistor manufactured in accordance with the process described herein.

The high voltage varistor assembly 16 shown in FIG. 2, includes a single, relatively thick disc 18 of ceramic material and two electrodes 14 disposed at the top and bottom sides of the disc 18. The disc 18 is formed by vertically stacking a plurality of the unfired press powdered discs 10, conventionally formed by previously described, well known processes, then sintering the stacked assembly by the normal high temperature firing cycle for the particular composition of metal oxides and additives comprising the discs 10.

It has been found that it is not necessary to apply pressure to a vertically stacked assembly 18 to assure close contact between adjacent pressed powder discs 10 during the firing cycle, wherein the weight of the elements provides sufficient pressure. However, a pressure may be applied to the elements by applying a clamping force to the stack through the end elements, particularly if the assembly 18 is in other than a vertical position during the firing cycle. The unfired pressed powder discs 10, may be formed by conventional uniaxial cold pressing techniques, have top and bottom surfaces sufficiently flat and parallel to assure close contact between adjacent discs 10 in the stack assembly 18 solely by the force of gravity. However, the top and bottom surfaces may be of any desired configuration, in so long as they are complementary so as to permit stacking of the discs with abutting top and bottom surface in close engagement with each other. Also, these unfired pressed powder disc 10 can be rubbed together as they are stacked to further assure adequate contact.

During the firing cycle, at least some of the additives melt into a glassy material in partial contact with the particles of the electrically-conductive metal oxide main components. As the sintering proceeds, grain growth of the electrically-conductive main components will result in a decrease in the surface area of the main components, so that eventually the glassy material comes to surround the particles of the electrically conductive main components. At least some of the main component particles of one disc 10 in contact with similar particles of an adjacent disc 10 will combine during this grain growth. Also the intergranular glassy material serves to join the conductive metal oxide particles of one disc 10 with closely spaced conductive metal oxide particles of an adjacent disc 10, resulting in a very strong mechanical bonding between adjacent discs 10 upon completion of the firing cycle. The electrical conductivity between the portions of the sintered disc 10 formed in accordance with this invention, from powder discs 10 is as good, or better, than the electrical conductivity between the varistor elements of the varistor assembly 12 shown in FIG. 1, as indicated by the durability characteristics of the varistor 18, that is, its ability to withstand high current surges.

What is claimed is:

1. A method of making a metal oxide varistor, which comprises the steps of:

forming a powdered mixture comprised of at least one electrically conductive metal oxide powder, and a small percentage of at least one preselected powdered additive, said additive being selected from the group consisting of different metal oxides and metal florides;

forming of said powdered mixture, by pressing, a plurality of blocks, each having complementary top and bottom surfaces, forming a stack of said plurality of blocks; (and)

sintering said stack of blocks, whereby said complementary abutting top and bottom surfaces of adjacent blocks are bonded together to form a varistor; and applying metallic contacts only to the top and bottom surfaces of said varistor.

2. The method of claim 1 wherein adjacent blocks are joined together during sintering by the electrically conductive metal oxide in adjacent blocks combining during grain growth.

3. The method of claim 1 wherein adjacent blocks are joined together by intergranular glassy material extending between adjacent blocks.

4. The method of claim 1 wherein the blocks are vertically stacked while being sintered, whereby the weight of the blocks provides pressure between complementary abutting top and bottom surfaces of adjacent blocks.

5. The method of claim 1 wherein a clamping force is applied to said stack while being sintered.

6. The method of claim 1 wherein said complementary top and bottom surfaces of said blocks are flat and parallel.

* * * * *

UNITED STATES PATENT AND TRADEMARK OFFICE

CERTIFICATE OF CORRECTION

PATENT NO. : 4,296,002

DATED : October 20, 1981

INVENTOR(S) : Theodore O. Sokoly, John Niedzialkowski

It is certified that error appears in the above-identified patent and that said Letters Patent are hereby corrected as shown below:

On the cover page of the patent at [Item 73] Assignee:, Delete "McGraw-Edison Company, Rolling Meadows, Ill." and substitute - Electric Power Research Institute, Inc., Palo Alto, California -

Signed and Sealed this

*Twenty-sixth* Day of *January 1982*

[SEAL]

*Attest:*

GERALD J. MOSSINGHOFF

*Attesting Officer*

*Commissioner of Patents and Trademarks*